US010028605B1

(12) United States Patent
Haarburger

(10) Patent No.: US 10,028,605 B1
(45) Date of Patent: Jul. 24, 2018

(54) SYSTEMS AND METHODS FOR A DETACHABLE KEY HOLDER AND ORGANIZER

(71) Applicant: NITE IZE, INC., Boulder, CO (US)

(72) Inventor: Daniel Haarburger, Boulder, CO (US)

(73) Assignee: Nite Ize, Inc., Boulder, CO (US)

( * ) Notice: Subject to any disclaimer, the term of this patent is extended or adjusted under 35 U.S.C. 154(b) by 0 days.

(21) Appl. No.: 15/398,656

(22) Filed: Jan. 4, 2017

(51) Int. Cl.

| | |
|---|---|
| ***A47F 7/00*** | (2006.01) |
| ***A47G 29/10*** | (2006.01) |
| ***E05B 19/00*** | (2006.01) |
| ***G09F 3/02*** | (2006.01) |
| ***G09F 3/04*** | (2006.01) |
| ***A45C 11/32*** | (2006.01) |

(52) U.S. Cl.
CPC ..... *A47G 29/10* (2013.01); *A45C 11/323* (2013.01); *A45C 11/326* (2013.01); *A45C 11/329* (2013.01); *E05B 19/00* (2013.01); *G09F 3/02* (2013.01); *G09F 3/04* (2013.01)

(58) Field of Classification Search
CPC ..... A47G 29/10; E05B 19/00; G09F 3/02; G09F 3/04; A47F 5/0876; A44B 15/00; A45C 11/32; A45C 11/327; A45C 11/328; A45C 2011/322; A45C 11/325; A45C 11/324; A45C 11/323; A45C 11/329; A45C 11/321; A45C 11/326
USPC ..... 211/85.9; 206/37.1, 37.2, 37.3, 37.4, 206/37.5, 37.6, 37.7, 37.8; 40/330
See application file for complete search history.

(56) References Cited

U.S. PATENT DOCUMENTS

| | | | | | |
|---|---|---|---|---|---|
| 1,574,832 | A * | 3/1926 | McDill | A45C 11/323 | 206/37.1 |
| 1,583,633 | A * | 5/1926 | Weissbrod | A45C 11/323 | 206/37.1 |
| 1,726,569 | A * | 9/1929 | Kasting | A45C 11/329 | 206/37 |
| 1,766,801 | A * | 6/1930 | Ragsdale | A45C 11/329 | 206/37.2 |
| 2,066,526 | A * | 1/1937 | Gladstone | A45C 11/329 | 206/37.4 |
| 2,564,382 | A * | 8/1951 | Stawsky | A45C 11/329 | 206/37.2 |
| 2,720,235 | A * | 10/1955 | Corson | A45C 11/323 | 206/37.1 |
| 2,871,902 | A * | 2/1959 | Weil | A45C 11/321 | 206/38.1 |
| 2,964,937 | A * | 12/1960 | Lautin | A45C 11/323 | 206/37.7 |
| 3,318,354 | A * | 5/1967 | Borisof | A45C 11/323 | 206/37 |
| 3,587,260 | A * | 6/1971 | Tajiri | E05B 19/00 | 70/395 |
| 3,587,262 | A * | 6/1971 | Kaye | A45C 11/323 | 70/456 R |

(Continued)

*Primary Examiner* — Jennifer E. Novosad
(74) *Attorney, Agent, or Firm* — Haynes and Boone, LLP

(57) ABSTRACT

A key holder includes a key tag, the key tag attached to a key. The key holder further includes a device body, the device body including a slot, the key located in the slot of the device body and the key tag wrapping around the device body from the slot to an outer portion of the device body, the outer portion of the device body including an attachment point for the key tag, the key tag attached to the outer portion of the device body and under sufficient tension to prevent the key from sliding out of the slot.

13 Claims, 7 Drawing Sheets

(56) References Cited

U.S. PATENT DOCUMENTS 4,086,796 A * 5/1978 Hellwig ..... A45C 11/323 70/456 B
4,422,316 A * 12/1983 Thomas ..... A47G 29/10 70/456 R
4,688,410 A * 8/1987 Jacobsen ..... A44B 15/00 70/458
4,799,587 A * 1/1989 Desanto ..... A45C 11/32 206/37.6
4,901,547 A * 2/1990 Dal Palu' ..... A45C 11/326 206/37.1
4,982,837 A * 1/1991 Toth ..... A44B 15/005 206/38.1
5,291,768 A * 3/1994 Rieffel ..... A44B 15/00 40/634
5,311,758 A * 5/1994 Neitzke ..... A45C 11/326 206/37.1
5,544,510 A * 8/1996 Botteon ..... A45C 11/326 70/456 R
5,833,054 A * 11/1998 Graves ..... A45C 11/329 206/37.4
5,927,116 A * 7/1999 Emoff ..... A44B 15/002 70/456 R
5,934,123 A * 8/1999 Eldredge ..... A44B 15/00 70/456 R
6,082,160 A * 7/2000 Martyniak ..... A44B 15/005 70/430
6,237,756 B1 * 5/2001 Caudle ..... A45C 11/328 206/37.2
6,435,340 B1 * 8/2002 Bowes, Jr. ..... A45C 11/32 206/37.1
2003/0150536 A1 * 8/2003 Morehead ..... A45C 1/06 150/134
2006/0151409 A1 * 7/2006 Schmoelzer ..... A47G 25/06 211/85.9
2009/0133455 A1 * 5/2009 Yang ..... A45C 11/323 70/457
2015/0289699 A1 * 10/2015 Gallup ..... A47G 29/10 211/175

* cited by examiner

SYSTEMS AND METHODS FOR A DETACHABLE KEY HOLDER AND ORGANIZER

BACKGROUND

Consumers in many scenarios will have the need to store, access, and label a variety keys. Many consumers have keys for multiple doors of dwellings and other household doors. Many keys for dwellings look exceedingly similar and therefore confusion among the keys may occur. When keys are placed on a key ring, the keys may not get lost, however, individually accessing each key without removing it from the key ring may be difficult. Therefore, it may be difficult to access and utilize individual keys. Therefore a system for organizing keys and making them individually available may be desirable.

BRIEF SUMMARY

In one embodiment, a key holder includes a key tag, the key tag attached to a key. The key holder further includes a device body, the device body including a slot, the key located in the slot of the device body and the key tag wrapping around the device body from the slot to an outer portion of the device body, the outer portion of the device body including an attachment point for the key tag, the key tag attached to the outer portion of the device body and under sufficient tension to prevent the key from sliding out of the slot. Optionally, the attachment point is a peg and the key tag includes an aperture for interfacing with the peg. Alternatively, the peg has a notch. In one alternative, the key tag has a key attachment system, the key attachment system including a receiving aperture having a narrowed portion and a neck and tabbed end, the tabbed end sized to fit through the receiving aperture but not the narrowed portion, the neck sized to slide into the narrow portion, wherein, to attach the key, the neck and tabbed end are first passed through a key aperture in the key and then through the receiving aperture and subsequently slid to the narrowed portion. In another alternative, the device body includes a first and second hook and a first and second hook receiving aperture, whereby the device body may be interfaced with and attached to a second device body having a matching first and second hook and a matching first and second hook receiving aperture. Optionally, the device body includes a unattached tag receiving aperture that includes a narrowed slot, such that the neck and tabbed end are attachable to the unattached tag receiving aperture by placing the neck and tabbed end through the unattached tag receiving aperture and sliding the neck to the narrowed slot. Alternatively, the device body includes a cutaway, allowing the neck and tabbed end to stretch to the unattached tag receiving aperture. In one configuration, the tag is composed of a material that holds the mark of a pen. In another configuration, the tag is stretchable. Optionally, the tag is composed of Starprene 5565 TPE, 68 Shore A.

In one embodiment, a method of holding a key includes providing a key tag and attaching the key tag to a key. The method further includes providing a device body, the device body including a slot and an attachment point on the outer portion of the device body; placing the key into the slot. The method further includes wrapping the key tag from the slot around the device body to the attachment point, such that the key tag provides tension to hold the key in the slot. Optionally, the attachment point is a peg and the key tag includes an aperture for interfacing with the peg. Alternatively, the peg has a notch. In one configuration, the key tag has an key attachment system, the key attachment system including a receiving aperture having a narrowed portion and a neck and tabbed end, the tabbed end sized to fit through the receiving aperture but not the narrowed portion, the neck sized to slide into the narrow portion, wherein, to attach the key, the neck and tabbed end are first passed through a key aperture in the key and then through the receiving aperture and subsequently slid to the narrowed portion. In another configuration, the device body includes a first and second hook and a first and second hook receiving aperture, whereby the device body may be interfaced with and attached to a second device body having a matching first and second hook and a matching first and second hook receiving aperture. Optionally, the device body includes a unattached tag receiving aperture that includes a narrowed slot, such that the neck and tabbed end are attachable to the unattached tag receiving aperture by placing the neck and tabbed end through the unattached tag receiving aperture and sliding the neck to the narrowed slot. Alternatively, the device body includes a cutaway, allowing the neck and tabbed end to stretch to the unattached tag receiving aperture. In one alternative, the tag is composed of a material that holds the mark of a pen. In another alternative, the tag is stretchable.

In one embodiment, a key holder includes a plurality of key tags, each key tag of the plurality of key tags attached to a key. The key holder further includes, a device body, the device body including a plurality of slots, whereby each key is located in one of the plurality of slots and each key tag of the plurality of key tags is wrapped from one of the plurality of slots to one of a plurality of attachment points on the device body, each of the plurality of attachment points on the device body corresponding to one of the plurality of slots, each key tag of the plurality of key tags attached to the outer portion of the device body and under sufficient tension to prevent each key from sliding out of the slot. Alternatively, the plurality of key tags includes four key tags each attached to one of 4 of the keys and the plurality of slots includes four slots and the plurality of attachment points includes four attachment points.

DETAILED DESCRIPTION

Certain terminology is used herein for convenience only and is not to be taken as a limitation on the embodiments of the systems and methods for a detachable key holder and organizer. In many embodiments, the system includes two primary pieces. A first piece is a case portion for storing and organizing keys. A second piece includes a key tag that interfaces with the first piece and is designed to hold a key. The key tag includes a markable portion. The two items are optimally arranged, such that the key tag is held under tension on the case portion when no key is attached to the key tag and such that the key is inserted into the case portion and the key tag portion stretches onto the case portion to hold the key in a slot portion of the case portion. The system allows for the quick and easy insertion and removal of a key, while arranging the tag portion such that is clearly visible.

Figure 1:
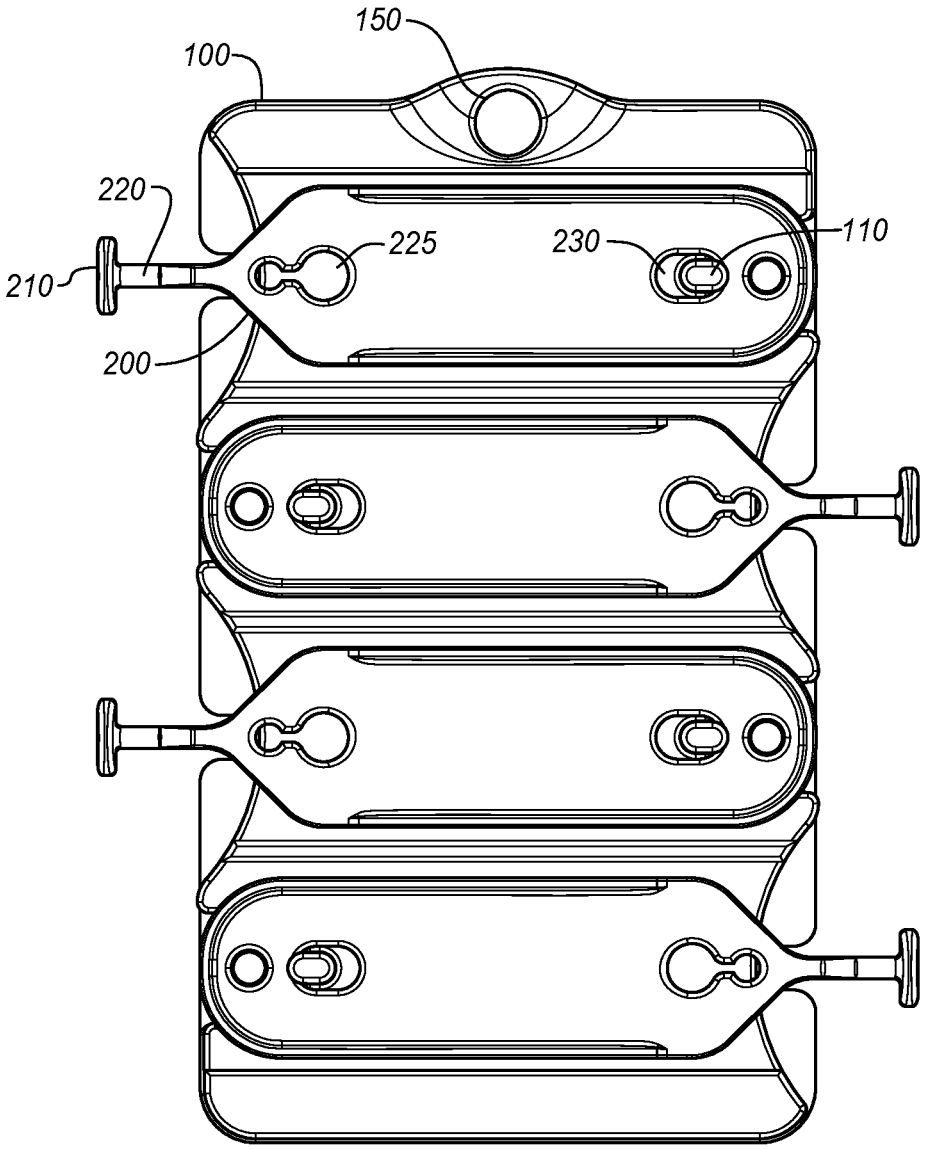
FIG. 1 shows one embodiment of a detachable key holder and organizer system with a plurality of tags.

FIG. 1 shows one embodiment of a detachable key holder and organizer system (holder system 100 for short). Holder system 100 includes a plurality of attachable tags 200. Each tag 200 includes tabbed end 210 with a neck portion 220. Tabbed end 210 with neck portion 220 are designed to be passed through the aperture of a key and then passed through aperture 225. Aperture 225 includes a widened opening and a narrowed opening, connected via a slit. In operation, once tabbed end 210 with neck portion 220 are passed through the aperture of a key, they are first inserted through widened opening and neck portion 220 is slide downwards through the slit to the narrowed opening in order to hold the key to tag 200. Tag 200 also includes aperture 230. Aperture 230 interfaces with peg 110. Peg 110 includes a notch, such that the edge of aperture 230 catches on the notch of peg 110. When neck portion 220 is folder underneath the holder system 100 or web neck portion 220 is attached to a key and the key inserted into one of the many slots, this provides for a tension between aperture 230 and peg 110, which holds the tag in place on the holder 100. The surface of the tag 200 is of such a material that it may be written upon with a standard pen or marker. One possible material for the tag 200 is Starprene 5565 TPE, 68 Shore A, however additional materials will occur to one of ordinary skill in the art in light of this disclosure. As shown in FIG. 1, the holder system 100 may have multiple slots for tags 200. Additionally, holder system 100 may have an aperture 150 for receiving a carabineer, ring, or other connector.

Figure 2:
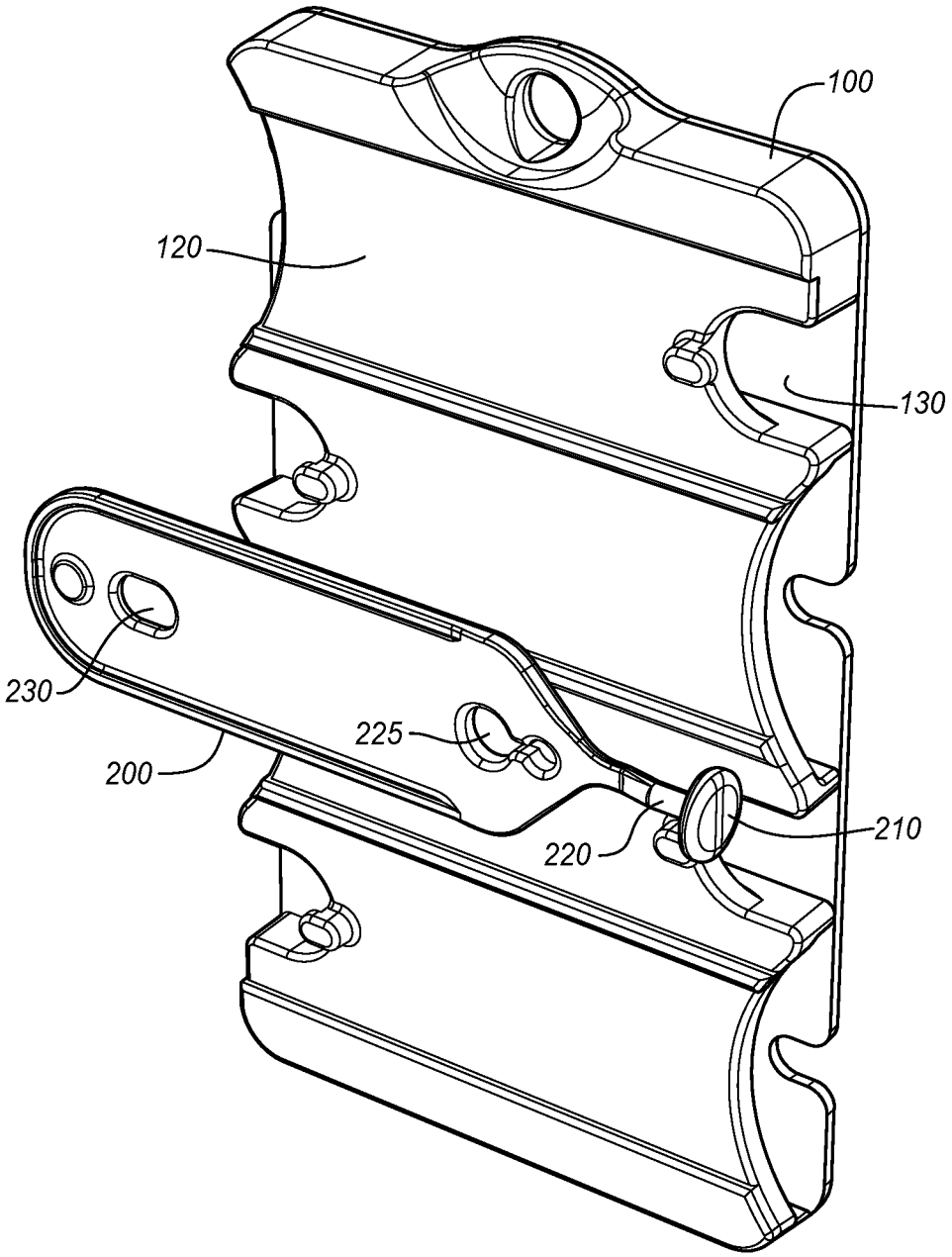
FIG. 2 shows another view of holder system of FIG. 1 with the tag removed.
Figure 3:
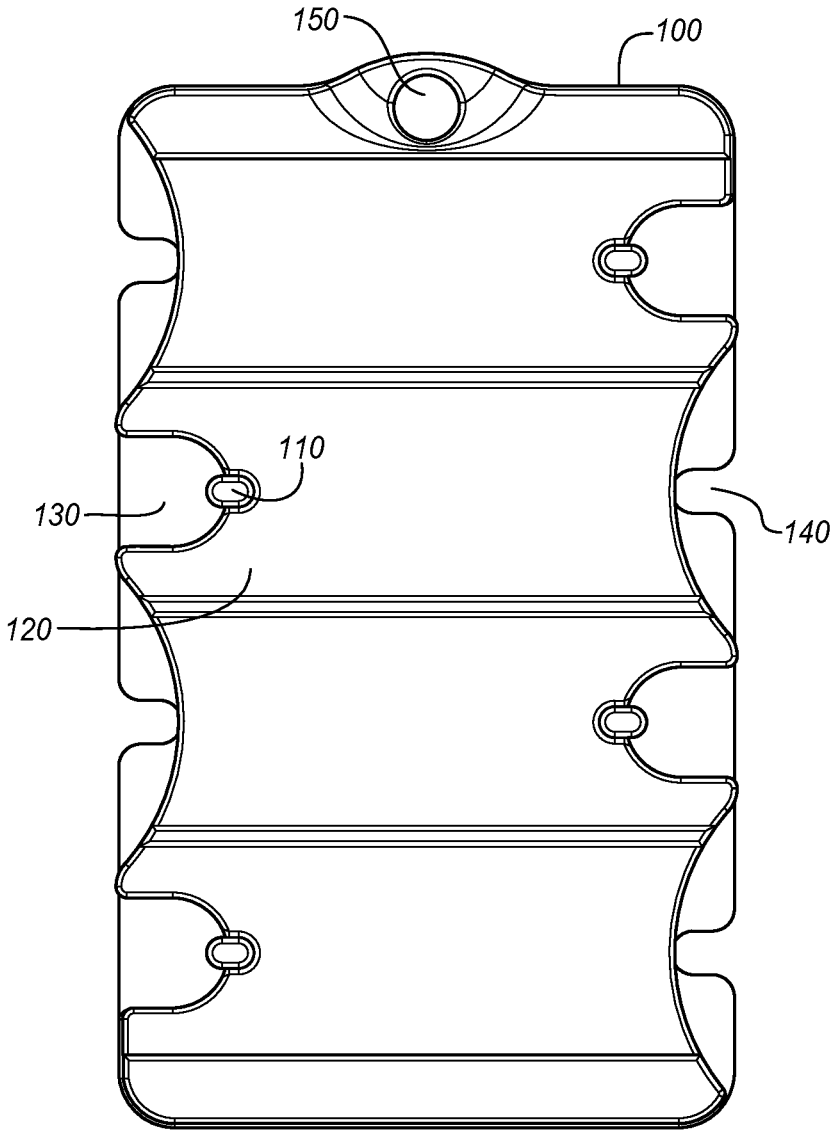
FIG. 3 shows another view of the holder system of FIG. 1 with no tags.
Figure 6:
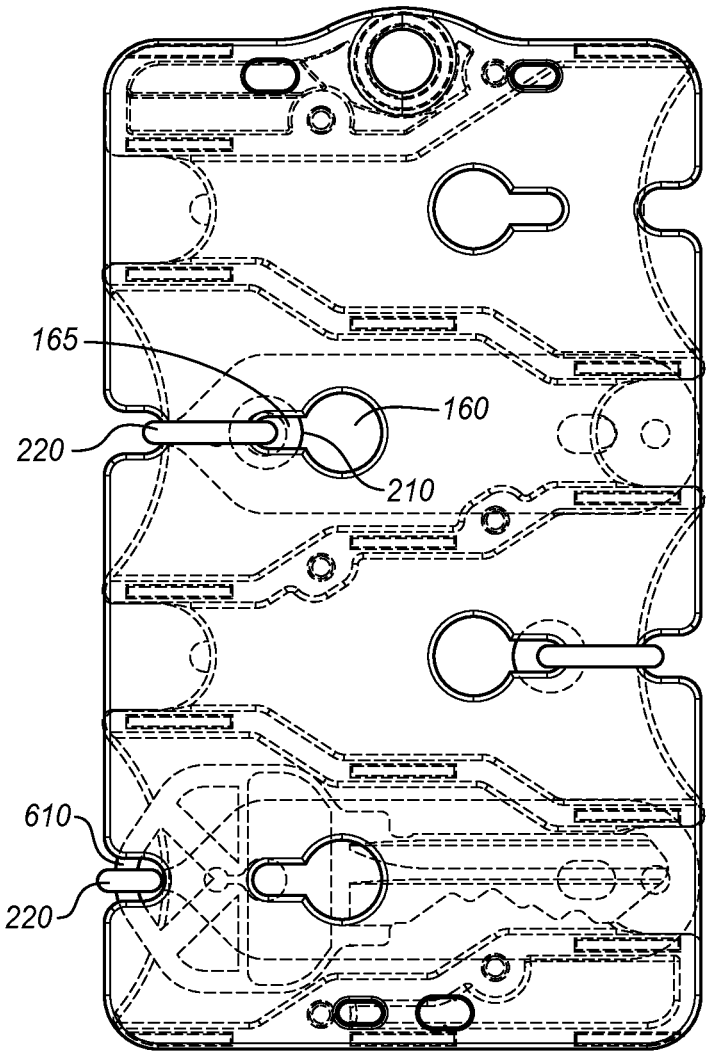
FIG. 6 show an x-ray view of the holder system of FIG. 1 including keys and tags.

FIG. 2 shows another view of holder system 100. In this view, the receiving area 120 for the tags 200 is shown. Additionally, slot 130 is visible. In use, a key is slid into slot 130 from the side opposite peg 110. The tension on aperture 230 from peg 110 prevents the key from sliding out of slot 130. FIG. 6 shows an x-ray view of the holder system 100. As can be seen, a standard key can be fit into the slot 130 when a tag is attached to the key and the key is held in place since any sliding out of slot 130 causes increased tension between aperture 230 of tag 200 and peg 110. FIG. 3 shows a front view of the holder system 100. Here, cutaway 140 is visible. As shown in FIG. 6, cutaway 140 is utilized to bend neck portion 220 around to the back side of the holder system 100 in order to attach empty tags 200.

Figure 4:
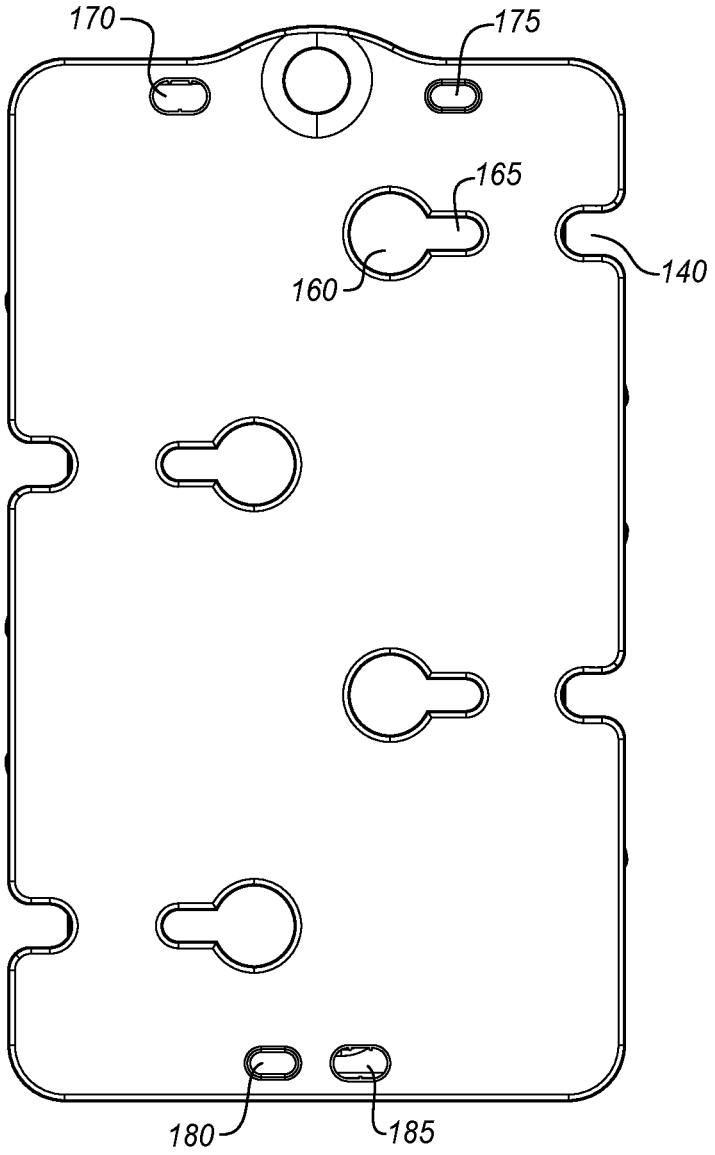
FIG. 4 shows a rear view of the holder system of FIG. 1.

FIG. 4 shows the rear of holder system 100. Rear view shows aperture 160 with narrowed slot 165. Aperture 160 receives tabbed end 210 with a neck portion 220. The neck portion 220 is then slid into narrowed slot 165. In this way, an empty tag 200 may be stored in holder system 100. As previously discussed, tension between aperture 230 of tag 200 and peg 110 and neck portion 220 held in narrowed slot 165 by tabbed end 210 holds the tag 200 in place. Additionally, visible are hook 175 and aperture 170 on the back of holder system 100. Additionally, at the bottom are similar hook 180 and aperture 185. This hook and aperture system on two holder systems 100, allows the two holder systems to be interconnected.

Figure 5:
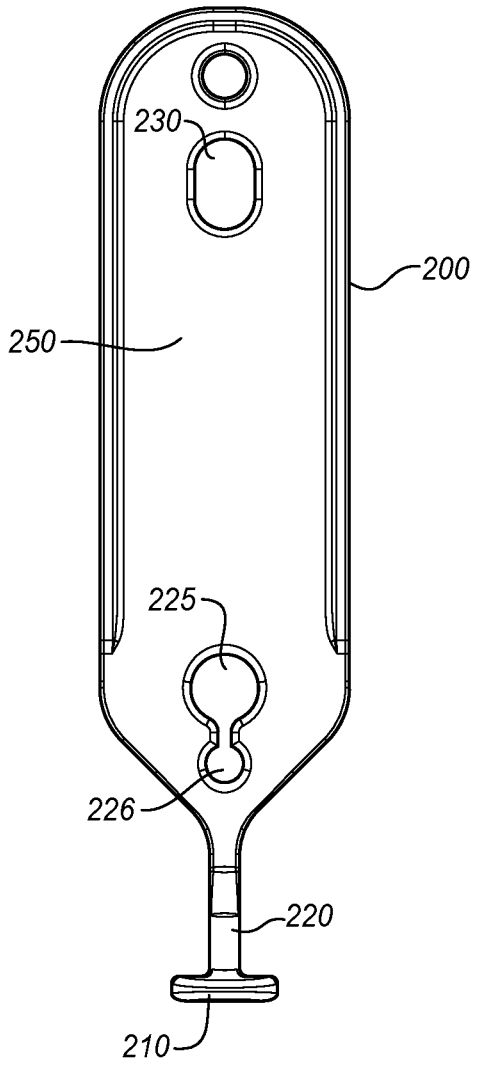
FIG. 5 shows one embodiment of a tag for use with the holder system of FIG. 1.

FIG. 5 shows another view of tag 200. As show, tag 200 includes an aperture 225 and a narrowed aperture 226. In order to attach a key to tag 200, the neck portion 220 and the tabbed end 210 are first passed through the key's aperture and then the tabbed end 210 is passed through aperture 225. Subsequently, the neck 220 is slid down into narrowed aperture 226 to lock the key in place. Note that this is one possible methodology of attaching a key to the tag 200 and other methods of attachment will occur to one of ordinary skill in the art in light of this disclosure. Primarily, some embodiments rely on the usage of a slot 130 that receives a key and the wrapping of the tag around the body of the holder system 100 and the inclusion of a peg that interfaces with an aperture on the tag in order to provide tension and hold the key in place.

Figure 7:
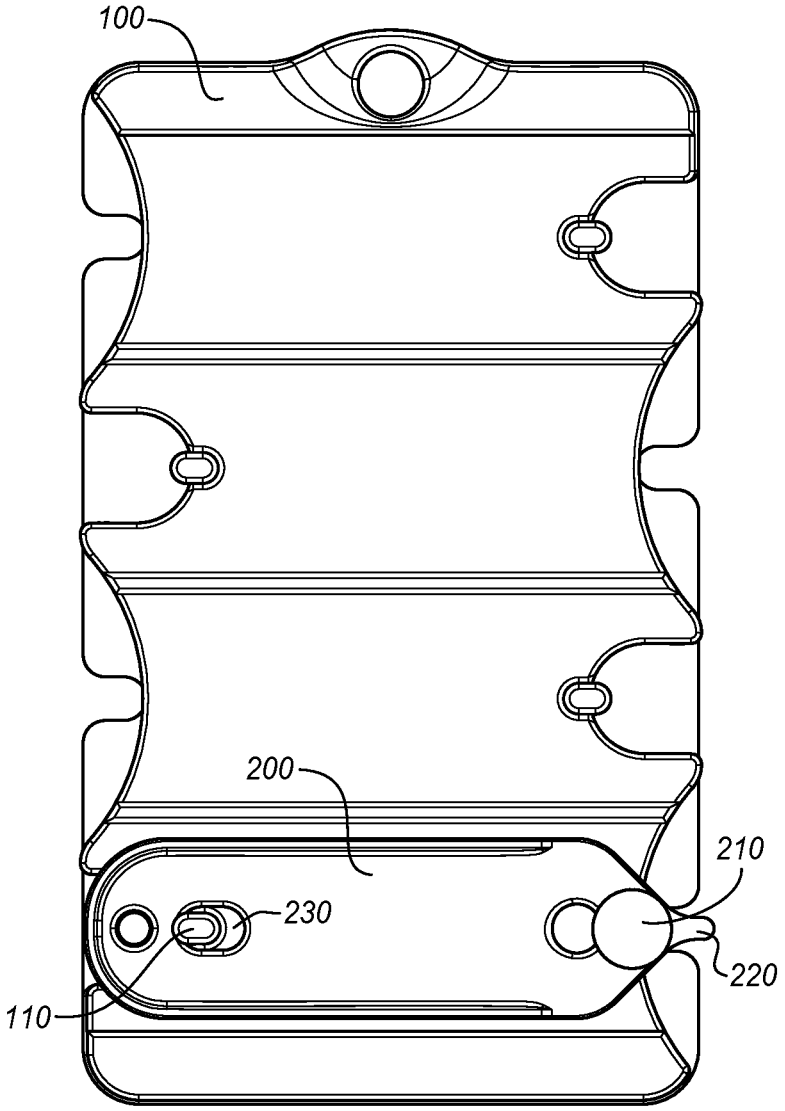
FIG. 7 shows an attached view of the holder system of FIG. 1.

FIGS. 6 and 7 show the holder system 100 in use. As shown, the second slot from the top may have a tag 200 attached. Tag 200 is held in place via tension resulting from neck portion 220 and tabbed end 210 being held in narrowed aperture 165 and aperture 230 being pulled against peg 110. The user may stretch the tag 200 slightly to release it from peg 110 and then remove the tag 200. Additionally, in the fourth slot from the top, a key 610 has been attached to a tag 200 via neck portion 220 and tabbed end 210. Tag 200 provides tension against peg 110 via aperture 230 and if the key 610 is slid in a removal direction, the aperture 230 will pull against peg 110 preventing the removal of key 610, until the aperture 230 is released from tab 110. Typically, holder system 100 is made of ABS or some other type of hard plastic type material that will occur to one of ordinary skill in the art in light of this disclosure.

Embodiments of the system essentially include holder with a slot that is sized and shaped to receive a key. Typically, the key is interconnected with a tag. The tag is wrapped around the body of the holder when the key is in the slot. The tag has an aperture that is placed on a peg or other holder that will provide for holding and tension when the key is advanced out of the slot, preventing its removal. The holding of a tag without a key functions in a similar fashion, whereby the tag includes a neck and a tabbed end that is inserted into an aperture of the outside of the holder. The aperture includes a narrowed portion, such that the neck but not the tabbed end of the neck can pass through it. In this way, tension acting on the aperture resting on the peg and the neck portion and tabbed end in the narrowed aperture holds the tag 200 in place.

Embodiments additionally include a feature for attaching the back of one holder to another. This typically includes two hook and aperture systems that simultaneously interface with each other holding the holders in a back to back configuration. Using this system, the holders may be held together and slid apart to release.

In some embodiments, a system for holding a key includes a stretchable tag that may attach to the body of a device and a slot, in which the key attached to the stretchable tag is placed, where the tag stretches from the slot around the device to a holding point, in some cases a peg. When the key is pulled in a removal direction, tension from the tag that is attached to the holding point prevents the removal of the key. Additionally, the body may have an attachment point for a tag, unattached to a key, where the tag has an attachment for interfacing with the attachment point, such that the tag may stretch between the attachment point and the peg, preventing the easy removal of the tag. The user may stretch the tag sufficiently to remove the tag. In many configurations the attachment point is an aperture and the tag includes a neck portion and a tabbed end that interfaces with the attachment point.

While specific embodiments have been described in detail in the foregoing detailed description, it will be appreciated by those skilled in the art that various modifications and alternatives to those details could be developed in light of the overall teachings of the disclosure and the broad inventive concepts thereof. It is understood, therefore, that the scope of this disclosure is not limited to the particular examples and implementations disclosed herein but is intended to cover modifications within the spirit and scope thereof as defined by the appended claims and any and all equivalents thereof.

What is claimed as new and desired to be protected by Letters Patent of the United States is:

1. A key holder comprising:

a key tag, the key tag adapted to be attached to a key;

a device body, the device body including a slot, the key adapted to be located in the slot of the device body and the key tag wrapping around the device body from the slot to an outer portion of the device body, the outer portion of the device body including an attachment point for the key tag, the key tag attached to the outer portion of the device body and under tension to prevent the key from sliding out of the slot, wherein the attachment point is a peg and the key tag includes an aperture for interfacing with the peg, the peg has a notch, and the key tag has a key attachment system, the key attachment system including a receiving aperture having a narrowed portion and a neck and tabbed end, the tabbed end sized to fit through the receiving aperture but not the narrowed portion, the neck sized to slide into the narrow portion, wherein, to attach the key, the neck and tabbed end are adapted to be first passed through a key aperture in the key and then through the receiving aperture and subsequently slid to the narrowed portion.

2. The key holder of claim 1, wherein the device body includes a first and second hook and a first and second hook receiving aperture, whereby the device body is adapted to interface with and attached to a second device body having a matching first and second hook and a matching first and second hook receiving aperture.

3. The key holder of claim 1, wherein the device body includes an unattached tag receiving aperture that includes a narrowed slot, such that the neck and tabbed end are attachable to the unattached tag receiving aperture by placing the neck and tabbed end through the unattached tag receiving aperture and sliding the neck to the narrowed slot.

4. The key holder of claim 3, wherein the device body includes a cutaway, allowing the neck and tabbed end to stretch to the unattached tag receiving aperture.

5. The key holder of claim 4, wherein the tag is composed of a material that holds the mark of a pen.

6. The key holder of claim 5, wherein the tag is stretchable.

7. The key holder of claim 6, wherein the tag is composed of Starprene 5565 TPE, 68 Shore A.

8. A method of holding a key, the method comprising:

providing a key tag and a key;

attaching the key tag to the key;

providing a device body, the device body including a slot and an attachment point on the outer portion of the device body;

placing the key into the slot;

wrapping the key tag from the slot around the device body to the attachment point, such that the key tag provides tension to hold the key in the slot, wherein the attachment point is a peg and the key tag includes an aperture for interfacing with the peg, peg has a notch, and the key tag has a key attachment system, the key attachment system including a receiving aperture having a narrowed portion and a neck and tabbed end, the tabbed end sized to fit through the receiving aperture but not the narrowed portion, the neck sized to slide into the narrow portion, wherein, to attach the key, the neck and tabbed end are first passed through a key aperture in the key and then through the receiving aperture and subsequently slid to the narrowed portion.

9. The method of claim 8, wherein the device body includes a first and second hook and a first and second hook receiving aperture, whereby the device body is adapted to interface with and attached to a second device body having a matching first and second hook and a matching first and second hook receiving aperture.

10. The method of claim 8, wherein the device body includes an unattached tag receiving aperture that includes a narrowed slot, such that the neck and tabbed end are attachable to the unattached tag receiving aperture by placing the neck and tabbed end through the unattached tag receiving aperture and sliding the neck to the narrowed slot.

11. The method of claim 10, wherein the device body includes a cutaway, allowing the neck and tabbed end to stretch to the unattached tag receiving aperture.

12. The method of claim 11, wherein the tag is composed of a material that holds the mark of a pen.

13. The method of claim 12, wherein the tag is stretchable.

* * * * *